US008707891B2

(12) United States Patent
Arnaboldi

(10) Patent No.: US 8,707,891 B2
(45) **Date of Patent: *Apr. 29, 2014**

(54) SPREADING HEAD PARTICULARLY FOR SPREADING ONE OR MORE ADHESIVES OR MIXTURES OF ADHESIVES

(75) Inventor: Riccardo Arnaboldi, Spresiano (IT)

(73) Assignee: Hip-Mitsu S.R.L., Spresiano (IT)

( * ) Notice: Subject to any disclaimer, the term of this patent is extended or adjusted under 35 U.S.C. 154(b) by 1490 days.

This patent is subject to a terminal disclaimer.

(21) Appl. No.: 11/808,277

(22) Filed: Jun. 8, 2007

(65) Prior Publication Data

US 2008/0026089 A1 Jan. 31, 2008

(30) Foreign Application Priority Data

Jul. 17, 2006 (IT) ..... TV2006A0123

(51) Int. Cl.
*B05C 5/02* (2006.01)

(52) U.S. Cl.
USPC ..... 118/411; 118/412; 118/429; 425/131.1; 425/133.5; 425/382 R; 425/462; 425/465; 156/500; 156/578

(58) Field of Classification Search
USPC ..... 118/400, 411, 412, 429, 313; 425/131.1, 135.5, 462, 465, 382 R; 156/500, 578; 427/286, 356
See application file for complete search history.

(56) References Cited

U.S. PATENT DOCUMENTS

| | | | | |
|---|---|---|---|---|
| 2,374,069 | A * | 4/1945 | Balthis | 264/211 |
| 3,887,322 | A * | 6/1975 | Johnson et al. | 425/466 |
| 4,476,165 | A | 10/1984 | McIntyre | |
| 5,120,484 | A * | 6/1992 | Cloeren | 264/173.12 |
| 5,769,947 | A * | 6/1998 | Krappweis | 118/411 |
| 6,106,900 | A | 8/2000 | Innes et al. | |
| 6,467,893 | B1 * | 10/2002 | Matsumoto et al. | 347/98 |
| 6,680,021 | B1 | 1/2004 | Kwok et al. | |
| 6,837,698 | B2 * | 1/2005 | Floyd et al. | 425/131.1 |
| 8,109,229 | B2 * | 2/2012 | Arnaboldi | 118/411 |

FOREIGN PATENT DOCUMENTS

| | | |
|---|---|---|
| EP | 1 101 537 A1 | 5/2001 |
| EP | 1 316 368 A1 | 6/2003 |
| JP | 63 291663 A | 11/1988 |

* cited by examiner

*Primary Examiner* — Yewebdar Tadesse
(74) *Attorney, Agent, or Firm* — Modiano & Associati; Albert Josif; Daniel O'Byrne

(57) ABSTRACT

A spreading head particularly for spreading one or more adhesives or mixtures of adhesives, of the hot-melt or cold type, comprising a body which has two or more ducts, which are all separate or of which two or more converge, each duct being connected to one or more feed channels for conveying the one or more adhesives or mixtures of adhesives to one or more extrusion chambers formed on the upper surface of the body; an abutment element for the one or more adhesives or mixtures of adhesives which exit from the one or more mixing chambers is associable in an upper region with the body.

37 Claims, 16 Drawing Sheets

SPREADING HEAD PARTICULARLY FOR SPREADING ONE OR MORE ADHESIVES OR MIXTURES OF ADHESIVES

The present invention relates to a spreading head particularly for spreading one or more adhesives or mixtures of adhesives, both of the hot-melt type and of the cold type.

BACKGROUND OF THE INVENTION

Currently it is known to use, for the application of adhesives to substrates made of various materials, such as for example fabrics or ribbons made of plastic material, spreading devices which comprise one or more spreading heads provided with a duct for feeding the adhesive, the delivery end of which faces, during use, a substrate which is made to advance in close contact therewith in the form of a ribbon.

The adhesive is introduced in the duct in the liquid state, typically by means of appropriately provided gear pumps, and can be applied either continuously or intermittently, by throttling the flow thereof by means of appropriately provided valves of a known type which are arranged in the spreading head.

Such valves further allow to vary the width of the region of application of the adhesive and to perform throttlings of the adhesive, with a preset pitch, transversely to the ribbon of substrate.

As an alternative to the valves, the variation of the width of the region of application of the adhesive can also be achieved by means of one or more inserts of a known type, which can be arranged automatically or manually within the duct so as to partially obstruct its cross-section, so as to adapt its width to the width of the ribbon.

It is also known to insert, transversely to the duct, appropriately provided contoured laminas, which are adapted to obstruct the duct partially so as to be able to obtain a selected distribution of the adhesive transversely to the substrate; it is thus possible to achieve, for example, a distribution of the adhesive which affects uniformly the entire substrate or also a distribution of the so-called "multiline" type, which is constituted by a plurality of longitudinal layers of adhesive which are mutually parallel and spaced.

These known types of spreading head, however, have drawbacks: first of all, they do not allow to obtain layers of different adhesives arranged side-by-side or laterally adjacent layers of a same adhesive with different grammages.

Moreover, the use of these known types of head entails a waste of adhesive if an adhesive of higher value and/or grammage (therefore also having a structural function) is required only in some regions of the substrate while in other regions an adhesive of lower value and/or grammage is sufficient, since it forces to use the higher-value and/or higher-grammage adhesive for all the regions of the substrate.

Moreover, said known types of head allow to obtain only a uniform film of adhesive in contact with both surfaces of the materials to be coupled; this entails the need to use a high-value adhesive even if its use is required only by one of the two surfaces to be coupled, with an additional waste of material.

Further, if the substrate is porous, the use of known types of head entails an additional waste of high-value adhesive, since said adhesive also acts as a filler for the pores of the substrate.

There are also applications in which such known types of head are used to provide membranes which in some regions must have breathability characteristics, and therefore require low grammages of applied adhesive, and in other regions must instead provide a vapor barrier effect and therefore require high adhesive grammages; to achieve this embodiment, known types of head require a double passage over the substrate, which is performed either with different heads or with a same head which is modified at a later time, and this increases the production times, and therefore the production costs, of producing said membranes.

Moreover, since many thermoplastic adhesives have a residual stickiness after their spreading, it is not possible to apply them with a double pass.

In the case of cold adhesives, spreading heads are known which allow to apply multiple superimposed layers; however, such heads do not allow to perform combined applications, i.e., multilayer products in certain regions and single-layer products in other regions, and also do not allow intermittent and/or combined applications of the so-called "multiline" type.

SUMMARY OF THE INVENTION

The aim of the present invention is to solve the above mentioned problems, eliminating the drawbacks of the cited background art, by providing a spreading head which allows to spread one or more adhesives onto a substrate, so as to obtain, in selected regions thereof, layers of the chosen type of chosen adhesive and/or of the chosen grammage.

Within this aim, an object of the invention is to provide a spreading head which allows to obtain, even in a single pass, the spreading onto a substrate of two or more superimposed layers of one or more adhesives.

Another object is to provide a spreading head which allows to achieve the spreading of one or more adhesives in multiple layers which are arranged side-by-side and optionally mutually spaced, in which each layer has the selected characteristics of width and/or composition and/or grammage and/or number of superimposed layers that compose it.

Another object is to provide a spreading head which allows the spreading in rapid succession of adhesives having different chemical properties and/or colorings, which may even be mutually incompatible.

Another object of the invention is to reduce the time and cost for producing membranes which have breathable regions and regions which are impermeable to vapor.

Another object of the invention is to reduce the waste of high-value adhesive in the process for spreading it onto a substrate, even a porous one.

Another object of the invention is to achieve a reduction in the costs for spreading one or more adhesives onto a substrate.

Another object is to provide a spreading head which is structurally simple and has low manufacturing costs.

This aim and these and other objects, as well as others which will become apparent hereinafter, are achieved by a spreading head particularly for spreading one or more adhesives or mixtures of adhesives, of the hot-melt or cold type, characterized in that it comprises a body which has two or more ducts, which are all separate or of which two or more converge, each duct being connected to one or more feed channels for conveying said one or more adhesives or mixtures of adhesives to one or more extrusion chambers formed on the upper surface of said body, an abutment element for said one or more adhesives or mixtures of adhesives which exit from said one or more mixing chambers being associable in an upper region with said body.

BRIEF DESCRIPTION OF THE DRAWINGS

Further characteristics and advantages of the invention will become better apparent from the following detailed description of a particular but not exclusive embodiment thereof, illustrated by way of non-limiting example in the accompanying drawings, wherein.

DESCRIPTION OF THE PREFERRED EMBODIMENTS

Figure 1:
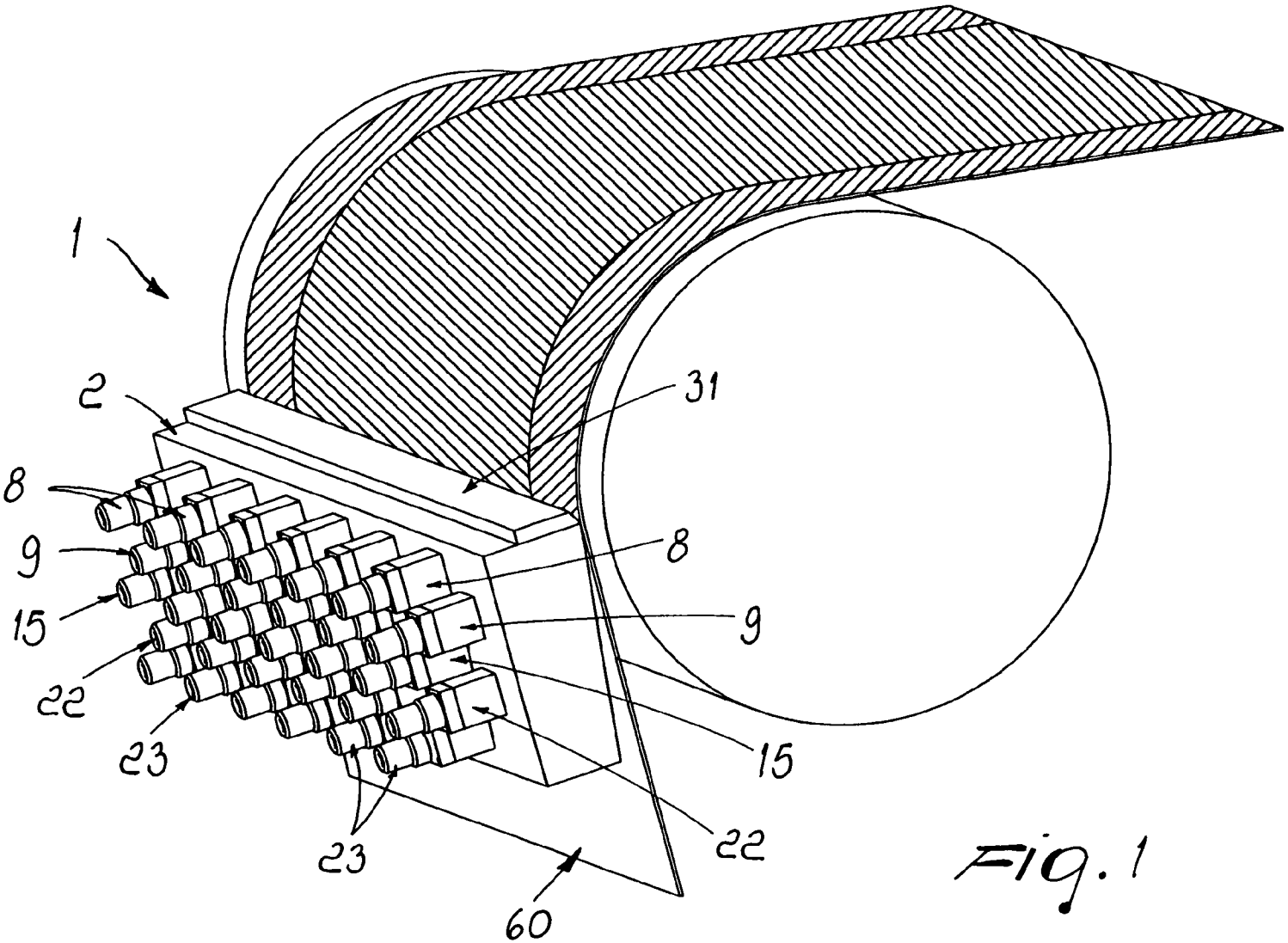
FIG. 1 is a perspective view of a spreading head according to the invention during its use.

In the exemplary embodiments that follow, individual characteristics, given in relation to specific examples, may actually be interchanged with other different characteristics that exist in other exemplary embodiments.

Moreover, it is noted that anything found to be already known during the patenting process is understood not to be claimed and to be the subject of a disclaimer.

With reference to the figures, the reference numeral 1 generally designates a spreading head, particularly for spreading one or more adhesives or mixtures of adhesives, of the hot-melt or cold type, on an appropriately provided substrate 60 constituted for example by a ribbon made of fabric or plastic material.

The spreading head 1 is constituted by a body 2 which is advantageously but not necessarily shaped approximately like a parallelepiped with a transverse cross-section which is approximately shaped like a right-angled trapezoid.

Two or more ducts are formed within the body 2; all of said ducts are separate, or two or more of them converge.

Figure 2:
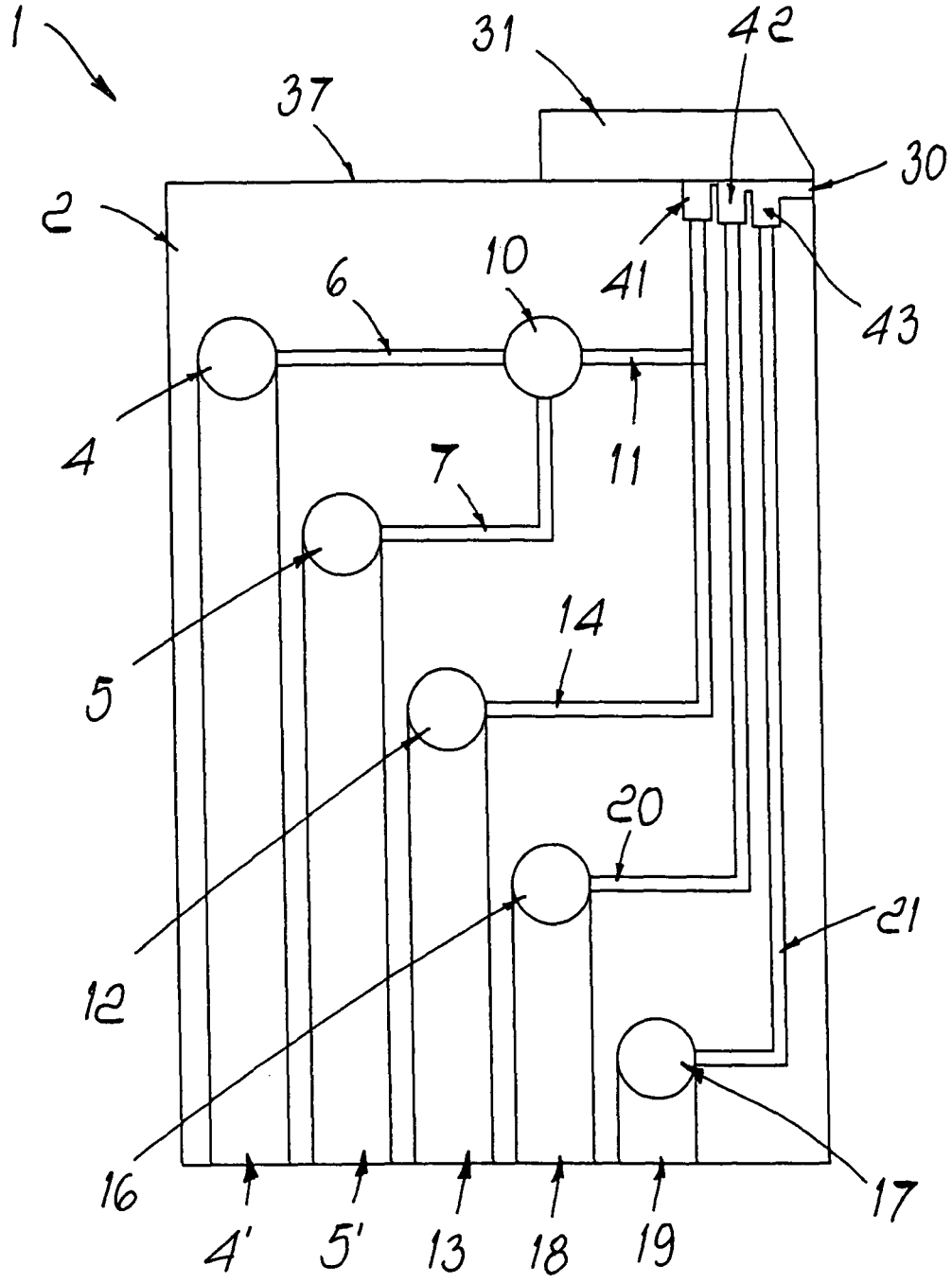
FIG. 2 is a schematic transverse sectional view of the spreading head of FIG. 1, in which the valves have not been shown and the second feed channels have been highlighted, the channels actually being not visible because they are arranged on different planes.

With reference to FIGS. 1 and 2, the body 2 has a first duct and a second duct, designated respectively by the reference numerals 4 and 5, which are approximately mutually parallel and affect longitudinally the body 2, preferably along most of its width; advantageously, the first and second ducts 4 and 5 respectively have one or more first and second accesses, designated respectively by the reference numerals 4' and 5', from which it is possible to introduce, for example by means of appropriately provided rotary pumps, not shown in the accompanying figures, one or more adhesives or mixtures of adhesives or catalysts for adhesives.

Advantageously, the first and second ducts 4 and 5 mutually converge inside the body 2; the first and second ducts 4 and 5 are connected respectively to first and second output ducts, designated respectively by the reference numerals 6 and 7, which converge in pairs, preferably with the interposition of appropriately provided first and second valves of a known type, designated respectively by the reference numerals 8 and 9, within appropriately provided mixing channels 10.

Advantageously, the first and second output ducts 6 and 7 are formed along axes which are substantially perpendicular to the first and second ducts 4 and 5; the first and second output ducts 6 and 7 are present in a chosen number and are distributed, in a preferably equidistant arrangement, respectively along the first and second ducts 4 and 5.

A first feed channel 11 for conveying said one or more adhesives or mixtures of adhesives to one or more appropriately provided first extrusion chambers 41 formed on an upper surface 37 of the body 2 protrudes from each of the mixing channels 10.

Advantageously but not necessarily, the one or more first extrusion chambers 41 are laterally adjacent and aligned along a same longitudinal axis with respect to the body 2.

With reference to FIGS. 1 and 2, the body 2 has a third duct 12, which is approximately parallel to the first duct 4 and the second duct 5 and again affects longitudinally the body 2 preferably along most of its width.

The third duct 12 has one or more third accesses 13 for an adhesive or a mixture of adhesives or catalyst for adhesives.

Figure 6:
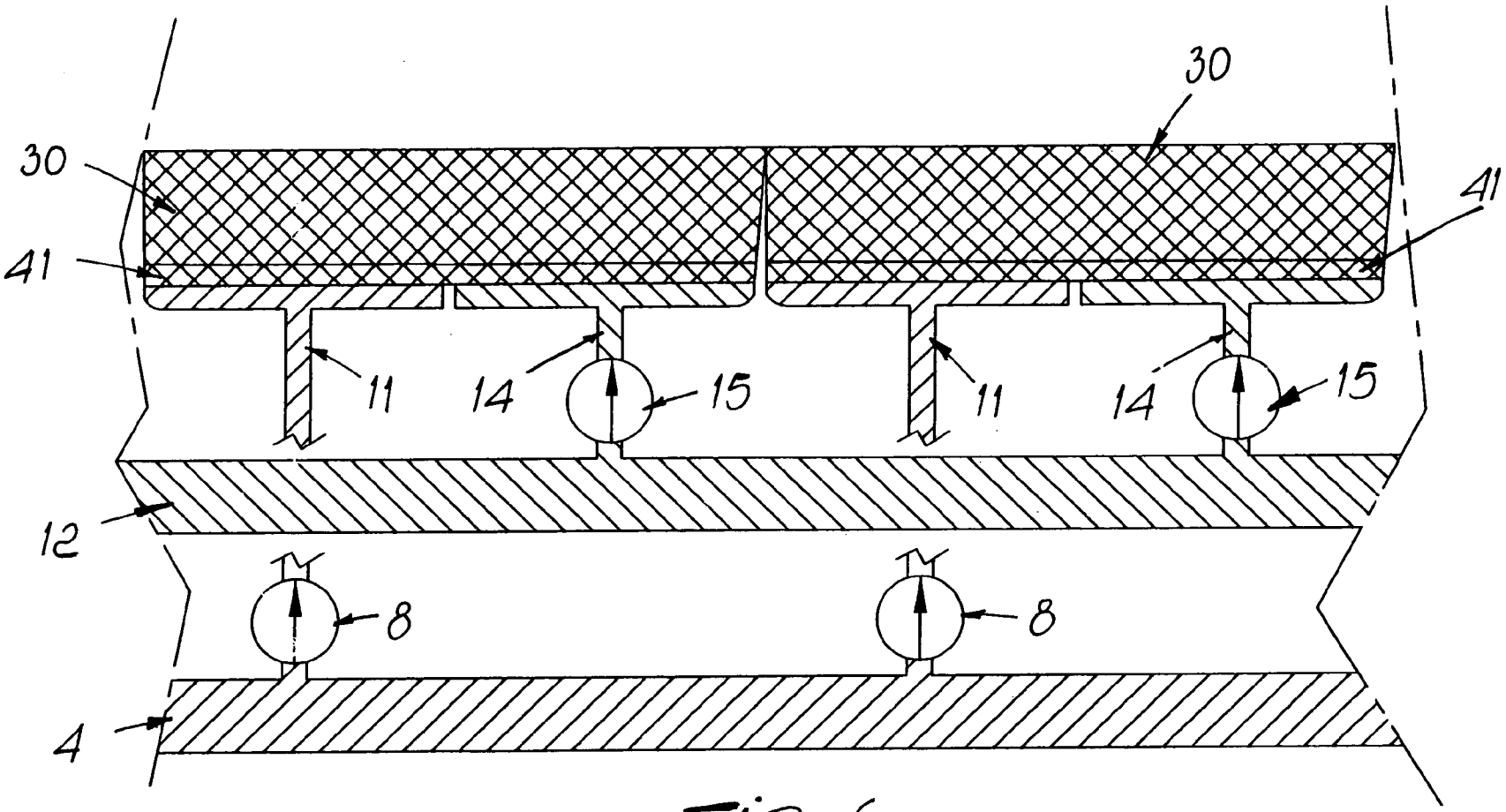
FIG. 6 is a schematic view of the flows of adhesives in the spreading head according to the invention.
Figure 7:
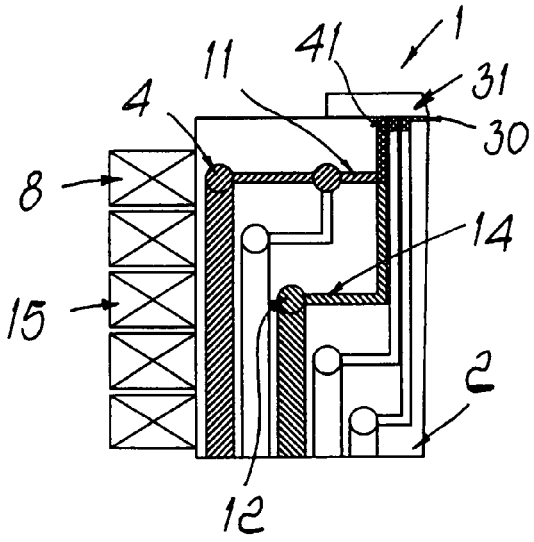
FIG. 7 is a transverse sectional view of a particular operating condition of the head according to the invention, in which the second feed channels have been highlighted, said channels actually not being visible because they are arranged on different planes.
Figure 8:
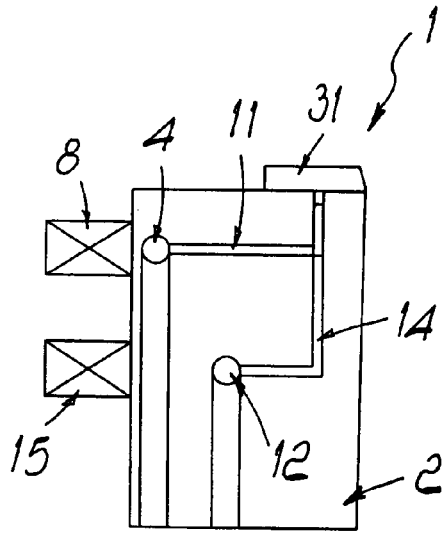
FIG. 8 is a transverse sectional view, which highlights the second feed channels, which are actually not visible because they are arranged on different planes, of a simplified configuration of the head according to the invention, which corresponds to the particular operating condition given in the description with reference to FIG. 7.

One or more second feed channels 14 exit from the third duct 12 and are designed to convey said one or more adhesives or mixtures of adhesives again to the first extrusion chambers 41 formed in the upper surface 37 of the body 2; as shown schematically in FIG. 6 (in which, for the sake of clarity in description, the second duct 5, the first and second output ducts, and the mixing chamber 10 have not been shown), each of the first extrusion chambers 41 receives therefore one or more feed channels 11 and one or more second feed channels 14.

Advantageously, the second feed channels 14 are connected to the third duct 12 through appropriately provided third valves 15 of a known type.

Advantageously, the second feed channels 14 are formed along axes which are substantially perpendicular to the longitudinal axis of the third duct 12; the second feed channels 14 are provided in a selected number and are distributed, preferably in an equidistant configuration, along the third duct 12.

The body 2 further has a fourth duct and a fifth duct, designated respectively by the reference numerals 16 and 17, which are approximately parallel to the first, second and third ducts and affect longitudinally the body 2 preferably along most of its width; the fourth and fifth ducts 16 and 17 respectively have fourth and fifth accesses, designated respectively by the reference numerals 18 and 19, for an adhesive or a mixture of adhesives or catalysts for adhesives.

Respectively one or more third feed channels 20 and one or more fourth feed channels 21 exit from the fourth and fifth ducts 16 and 17 to convey said one or more adhesives or mixtures of adhesives respectively to one or more second extrusion chambers 42 and to one or more third extrusion chambers 43 formed on the upper surface 37 of the body 2.

The third feed channels 20 and the fourth feed channels 21 are connected to the respective fourth and fifth ducts respectively by means of appropriately provided fourth and fifth valves of a known type, designated respectively by the reference numerals 22 and 23.

Advantageously, the third and fourth feed channels 20 and 21 are formed along axes which are substantially perpendicular respectively to the longitudinal axes of the fourth and fifth ducts 16 and 17; the third and fourth feed channels 20 and 21 are provided in a selected number and are distributed, preferably equidistantly, respectively along the fourth and fifth ducts 16 and 17.

Advantageously, the second extrusion chambers 42 and the third extrusion chambers 43 are aligned respectively along two axes which are arranged longitudinally to the body 2 and are substantially parallel and spaced with respect to each other and to the axis along which the first extrusion chambers 41 are aligned.

Advantageously, a plurality of sets of three extrusion chambers are formed on the upper surface 37 of the body 2; said sets are mutually laterally adjacent and each set is constituted by a first extrusion chamber 41, a second extrusion chamber 42 and a third extrusion chamber 43, which are arranged parallel to each other and to the longitudinal axis of the body 2.

The shape, and therefore the size, of the first, second and third extrusion chambers that compose each of said sets are substantially the same.

The longitudinal extension of the first, second and third extrusion chambers of each of said sets of three extrusion chambers is therefore identical, while the longitudinal extension of two of said sets arranged mutually side by side can be different; this allows to obtain in output layers of adhesive which are laterally side by side and have different widths.

Figure 3:
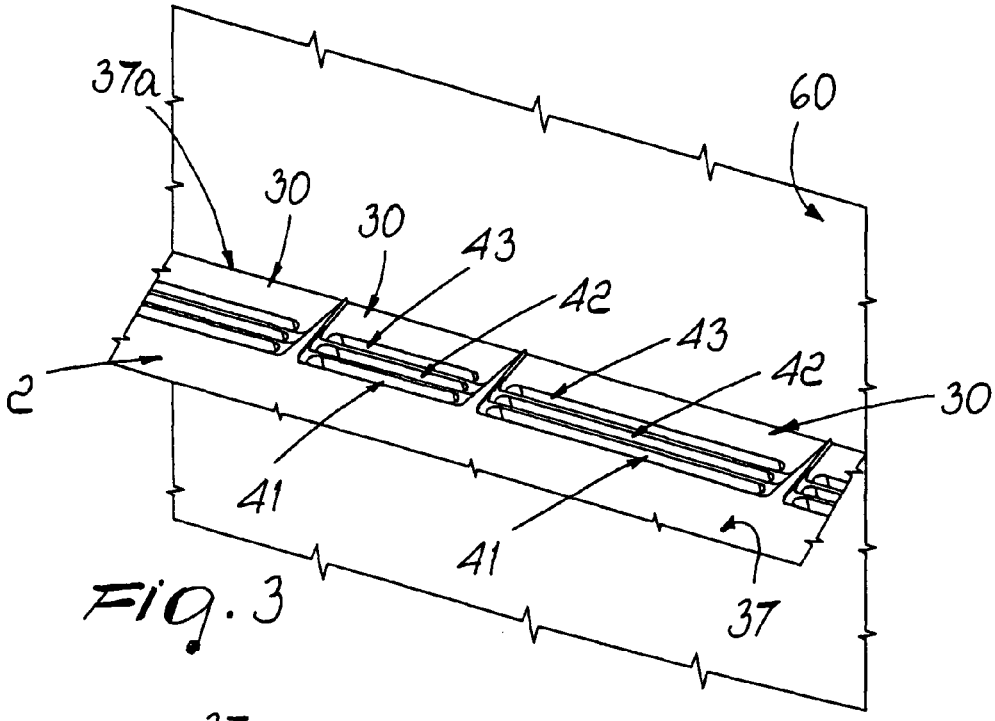
FIG. 3 is a perspective view of a detail of the upper surface of the body of the spreading head according to the invention.

In the example shown in FIG. 3, some of said sets of three extrusion chambers are shown; in each of said sets, the first extrusion chamber 41 lies furthest from the lamination plane, while the third chamber 43 lies closest to said lamination plane.

Advantageously, in each of the sets of three extrusion chambers, the outlet of the third extrusion chamber 43, which lies closest to the lamination plane, is, with respect to said lamination plane, at a lower height than the outlet of the adjacent second extrusion chamber 42, and the latter in turn is at a lower height than the adjacent first extrusion chamber 41 which lies furthest from the lamination plane; this allows to achieve the extrusion of two or three superimposed layers of adhesive which, after exiting from the respective first, second and third extrusion chamber; remain one on top of the other due to their different relative densities.

Figure 4:
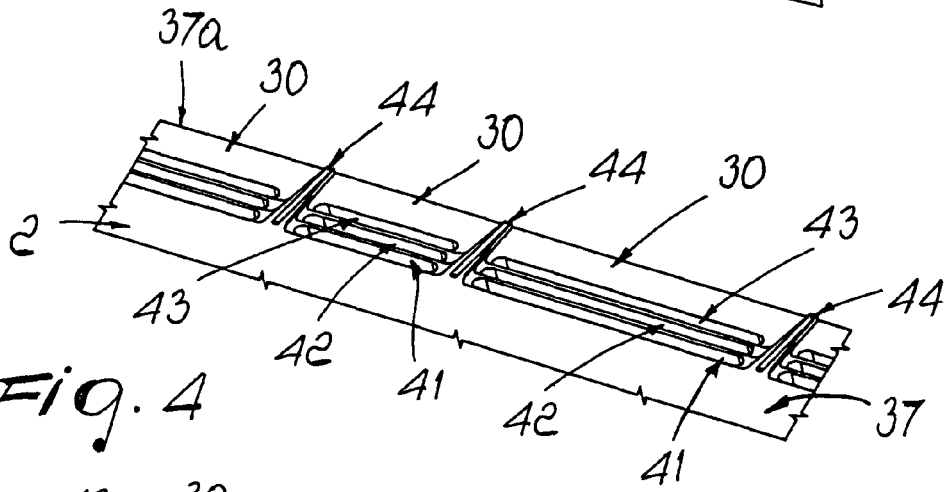
FIG. 4 is a perspective view of a detail of the upper surface of the body of a second embodiment of the spreading head according to the invention.

As an alternative, with reference to FIG. 4, the third feed channels 20 and/or the fourth feed channels 21 can be connected to one or more fourth extrusion chambers 44, which have different shapes and arrangements with respect to the first, second and third extrusion chambers described earlier; the fourth extrusion chambers 44 are arranged along an axis which is perpendicular to the axis of the first, second and third extrusion chambers, and are interposed between each pair of the sets of three extrusion chambers.

The fourth extrusion chambers 44 start from the perimetric edge 37*a* of the upper surface 37 of the body 2 which is directed toward the substrate 60 during use; as described in greater detail hereinafter, this configuration of the extrusion chambers allows to obtain in output laterally adjacent layers of adhesive spaced by microlayers of reduced width.

Advantageously, on the upper surface 37 of the body 2 there is a slit 30, provided preferably by removing material and so as to affect the outlet of at least the third extrusion chambers 43 which lie closer to the lamination plane: said slit arranges on a lower plane the outlet of the third extrusion chambers 43 with respect to the plane of arrangement of the second extrusion chamber 42 and the first extrusion chamber 41.

The slit 30 guides the outflow of the layer or layers of adhesive from the body 2 onto the substrate 60.

Figure 5:
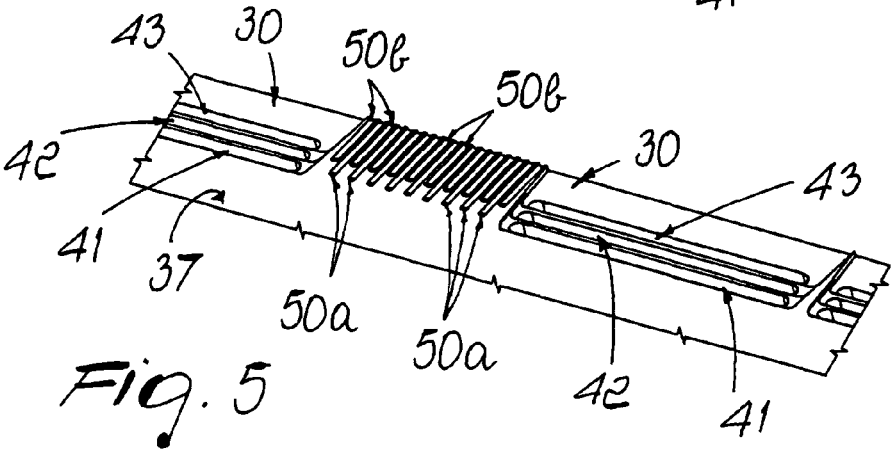
FIG. 5 is a perspective view of a detail of the upper surface of the body of a third embodiment of the spreading head according to the invention.

In another embodiment, shown in FIG. 5, one or more of the first extrusion chambers 41 and/or of the second extrusion chambers 42 and/or of the third extrusion chambers 43 and/or of the fourth extrusion chambers 44 may have, along an axis which lies longitudinally with respect to the body 2, reduced lengths so as to constitute microchannels, which are designated by the reference numerals 50*a* and 50*b*.

In the exemplary embodiment shown in FIG. 5, the microchannels 50*a* and 50*b* are arranged at right angles to the first, second and third extrusion chambers, are mutually parallel and are interposed between two pairs of said sets of three extrusion chambers.

The configuration of the microchannels 50*a* and 50*b* with respect to the upper surface 37 of the body 2 is preferably comb-like, with teeth which advantageously have two different lengths and are arranged preferably alternately.

Advantageously, an abutment element 31 for the one or more adhesives or mixtures of adhesives that exit from the first, second, third or fourth mixing chambers formed in the upper surface 37 is fixed to the upper surface 37 of the body 2; the abutment element 31, which is preferably approximately shaped like a parallelepiped with a transverse cross-section shaped like a right-angled trapezoid, guides the one or more adhesives or mixtures of adhesives so that they exit from the slits 30.

Operation is therefore as follows. With reference to the accompanying figures, it is possible to introduce, for example by means of appropriately provided rotary pumps, not shown in the accompanying figures, one or more adhesives or mixtures of adhesives in the liquid state, or optionally one or more appropriately provided catalysts, in one or more among the first duct 4, the second duct 5, the third duct 12, the fourth duct 16 and the fifth duct 17.

By adjusting appropriately the open or closed state of the first, second, third, fourth and fifth valves, it is possible to feed into the first and/or second and/or third and/or fourth extrusion chambers the chosen adhesive or mixture of adhesives so as to obtain in output a chosen configuration of the spread layer or layers of adhesive.

For example, with reference to FIGS. 7 to 11, it is possible to feed just the first duct 4 and the third duct 12 with two separate adhesives or alternately with the same adhesive having a different grammage, or also with an adhesive and an appropriately provided catalyst.

Figure 10:
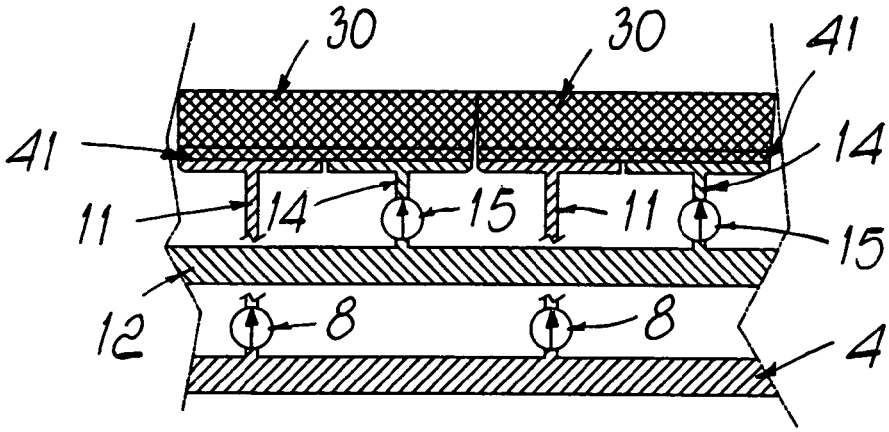
FIG. 10 is a schematic view of the path of the flows of the adhesives in the operating condition described for FIG. 7.

As shown in FIG. 10, by opening one or both of the first valve 8 and third valve 15 which are interposed respectively between the first duct 4, the third duct 12 and a same first extrusion chamber 41, it is possible to allow the access to the first extrusion chamber 41 of just one or both of the adhesives or mixture of adhesives or adhesive and catalyst that are present respectively in the first duct 4 and in the third duct 12.

If, as shown in FIG. 10, both the first valve 8 and the third valve 15 are open, in the first extrusion chamber 41 mixing occurs between the two adhesives or between the adhesive and the catalyst, contained respectively in the first and third ducts; from the first extrusion chamber 41, the mixture of adhesives or the adhesive mixed with the catalyst is then extruded through the slit 30.

As an alternative, if only one of the first and third valves respectively of the first feed channel 11 and of the second feed channel 14 that lead into a same first extrusion chamber 41 is open, only one of the two adhesives flows into the chamber and therefore exits directly through the slit 30.

Figure 9:
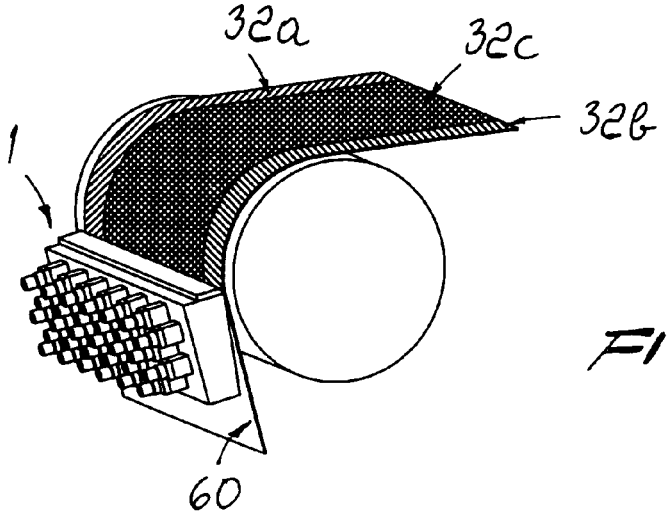
FIG. 9 is a perspective view of the head of FIG. 7.

In this manner it is therefore possible to obtain a plurality of layers of adhesive which are laterally mutually adjacent and have the chosen composition; the embodiment shown in FIG. 9, for example, obtains a first layer 32*a* of a first adhesive, a second layer 32*b* of a second adhesive and a third layer 32*c*, which is interposed laterally between the preceding ones and is constituted by a mixture thereof.

This distribution of the layers of adhesive in output can also be achieved with a simplified configuration of the spreading head 1 in which the body 2 has only the first duct 4 and the third duct 12, from which a corresponding number of first and second feed channels 11 and 14 exit respectively through one or more first valves 8 and third valves 15.

Figure 11:
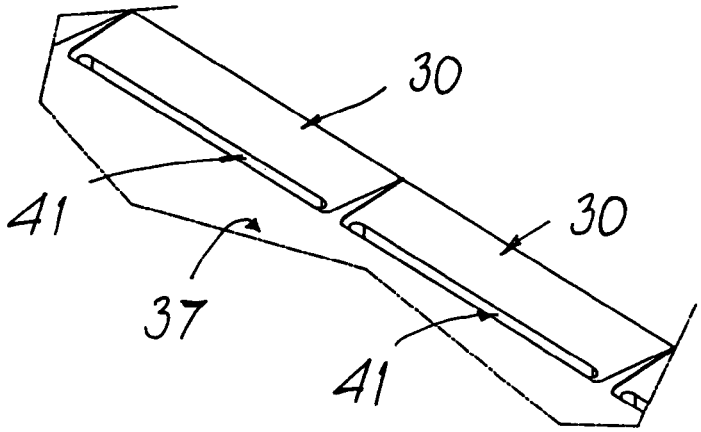
FIG. 11 is a view of a detail of the upper surface of the body of the simplified configuration shown in FIG. 8.
Figure 12:
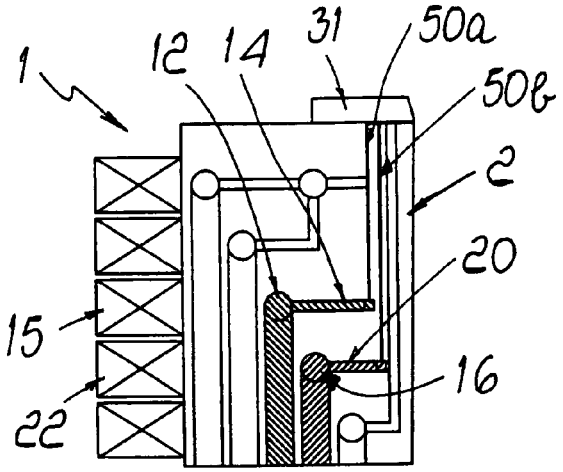
FIG. 12 is a transverse sectional view of another particular operating condition of the head according to the invention.

In this simplified configuration, on the upper surface 37 of the body 2 there are only the first extrusion chambers 41, each of which is connected in input to the first feed channel 11 and to the second feed channel 14; as shown in FIG. 11, the various first extrusion chambers 41 in this case are mutually laterally adjacent.

With reference to FIGS. 12 to 16, it is further possible to feed only the third duct 12 and the fourth duct 16 with two separate adhesives or as an alternative with a same adhesive having a different grammage.

Figure 15:
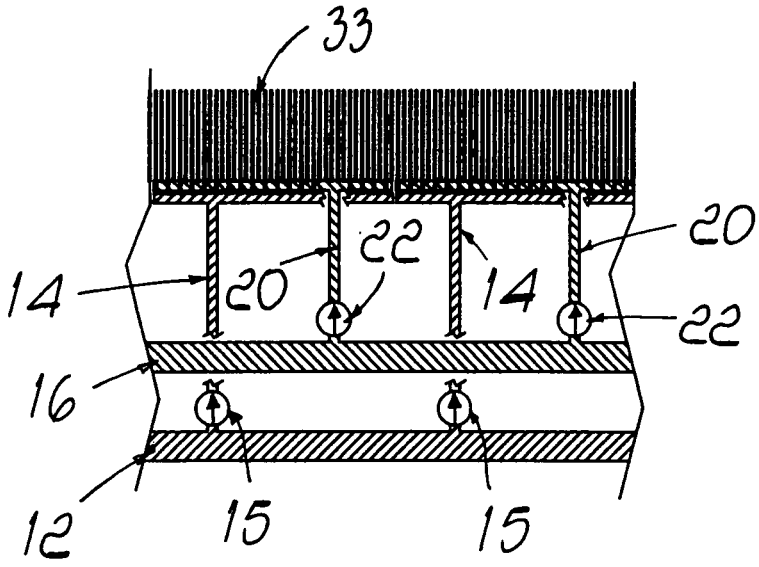
FIG. 15 is a schematic view of the path of the flows of the adhesives in the operating condition of FIG. 12.

As shown in FIG. 15, by appropriately adjusting the opening of the third valves 15 and fourth valves 22 it is possible to make the two adhesives converge within the microchannels 50*a* and 50*b* alone.

Figure 13:
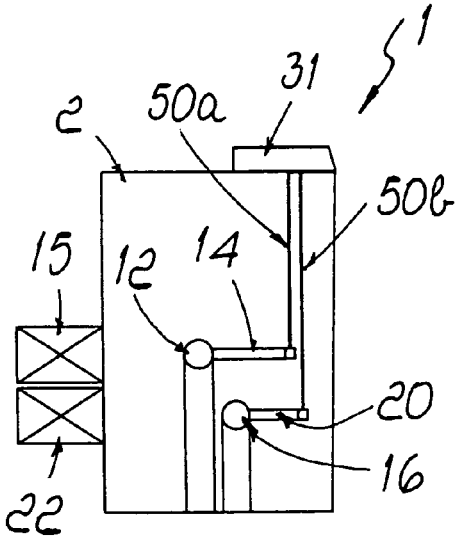
FIG. 13 is a transverse sectional view of a simplified configuration of the head according to the invention, which corresponds to the particular operating configuration given in the description which refers to FIG. 12.
Figure 14:
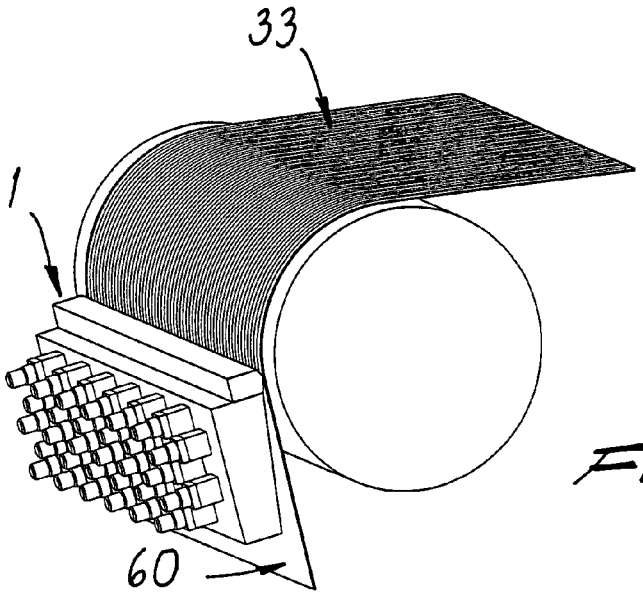
FIG. 14 is a perspective view of the head of FIG. 12.
Figure 16:
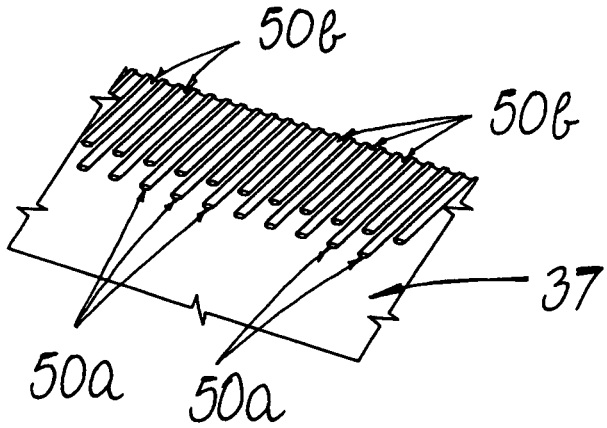
FIG. 16 is a view of a detail of the upper surface of the body of the simplified configuration shown in FIG. 13.

If, as shown in FIGS. 13, 15 and 16, in the upper surface 37 of the body 2 there are only the microchannels 50*a* and 50*b*, it is possible to spread an alternation of microlayers, generally designated by the reference numeral 33, of the two adhesives.

With reference to FIGS. 13, 15 and 16, said distribution of the adhesive layers in output can also be achieved with a simplified configuration of the spreading head 1, in which the body 2 has only the third duct 12 and the fourth duct 16, from which a corresponding number of second and third feed channels 14 and 20 protrude respectively through one or more third valves 15 and fourth valves 22 and are connected respectively to one or more microchannels 50*a* and 50*b*, which are arranged in a comb-like configuration and are mutually alternated.

Figure 17:
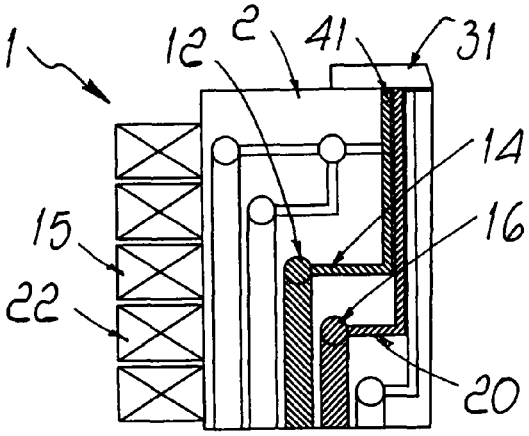
FIG. 17 is a transverse sectional view of another particular operating condition of the head according to the invention, illustrating also the first extrusion chambers and the fourth feed channels, which are actually not visible.

With reference to FIGS. 17 to 21, it is further possible to feed only the third duct 12 and the fourth duct 16 with two separate adhesives or, as an alternative, with a same adhesive having a different grammage; as shown in FIG. 17, by means of the third valves 15 and the fourth valves 22 it is possible to make one of the two adhesives converge into the first extrusion chambers 41 and make the other adhesive converge into the fourth extrusion chambers 44 which are interposed between the first extrusion chambers 41 which are arranged laterally side-by-side.

It is therefore possible to obtain in output from an extrusion tool 3 a series of layers of adhesive 32 which are laterally adjacent and are spaced by microlayers 33 of a different adhesive.

Figure 19:
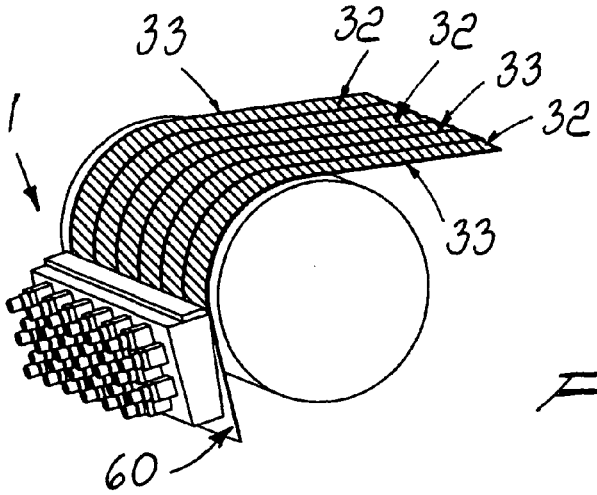
FIG. 19 is a perspective view of the head of FIG. 17.
Figure 20:
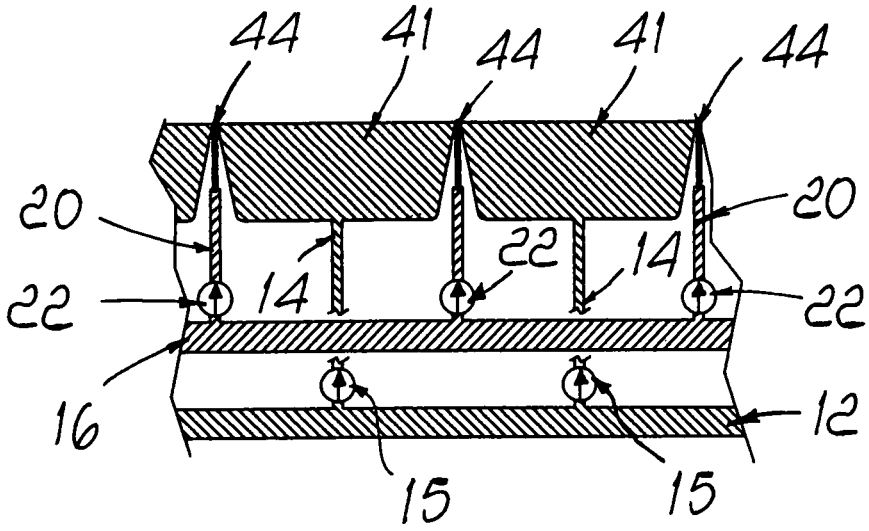
FIG. 20 is a schematic view of the path of the flows of the adhesives in the operating condition of FIG. 17.

For example, with reference to the embodiment shown in FIG. 19, six layers 32 of a first adhesive, each enclosed between two microlayers 33 of a second adhesive, have been obtained.

Figure 18:
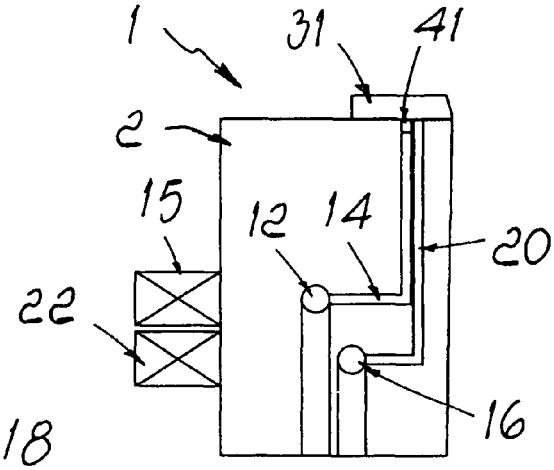
FIG. 18 is a transverse sectional view of a simplified configuration of the head according to the invention, which corresponds to the particular operating condition given in the description which refers to FIG. 17.
Figure 21:
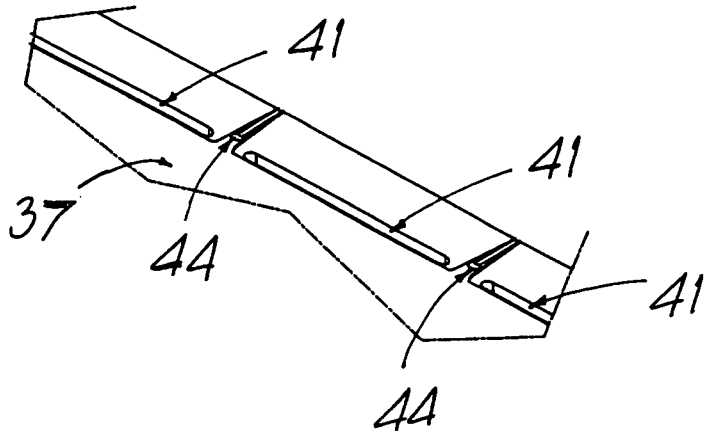
FIG. 21 is a view of a detail of the upper surface of the body of the simplified configuration shown in FIG. 18.
Figure 22:
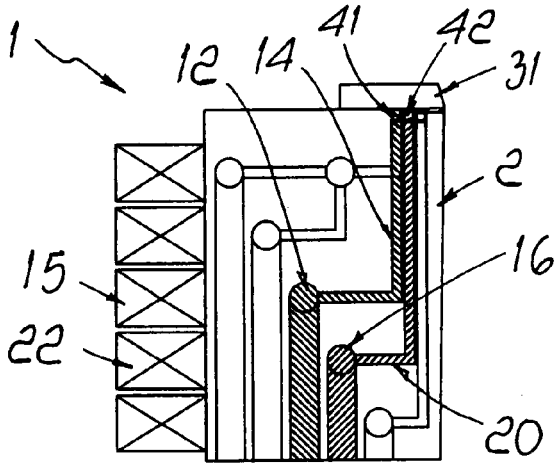
FIG. 22 is a transverse sectional view of another particular operating condition of the head according to the invention.

With reference to FIGS. 18 and 21, this distribution of the layers of adhesive in output can also be achieved with a simplified configuration of the spreading head 1, in which the body 2 has only the third duct 12 and the fourth duct 16, from which a corresponding number of second and third feed channels 14 and 20 exit respectively through one or more third valves 15 and fourth valves 22; said feed channels are connected respectively to one or more first extrusion chambers 41 and to one or more fourth extrusion chambers 44.

With reference to FIGS. 22 to 26, it is further possible to feed only the third duct 12 and the fourth duct 16 with two separate adhesives or, as an alternative, with a same adhesive having a different grammage; the third duct 12 and the fourth duct 16 are connected respectively to the first extrusion chambers 41 and to the second extrusion chambers 42 which are contiguous to these last.

By acting on the open condition of the third valves 15 and the fourth valves 22 it is possible to make one or the other of the adhesives flow respectively to said first or second extrusion chambers; in this manner, it is possible to obtain in output from the extrusion tool 3 a series of layers of adhesive which are laterally mutually adjacent and have the chosen composition.

Figure 24:
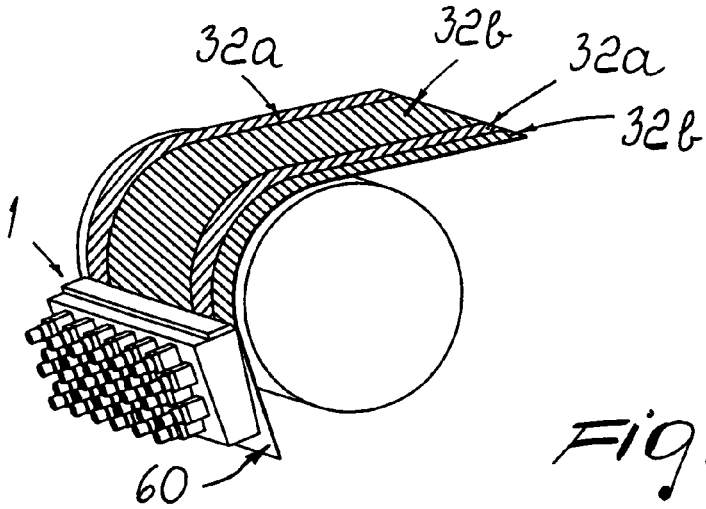
FIG. 24 is a perspective view of the head of FIG. 22.
Figure 25:
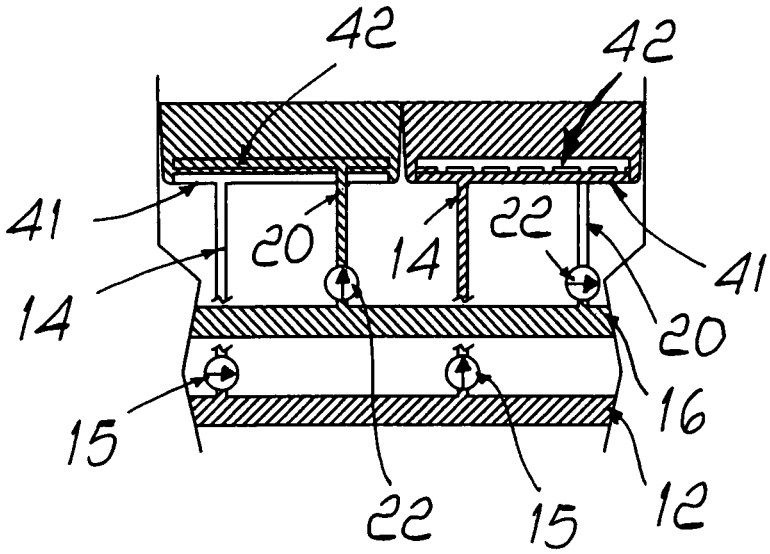
FIG. 25 is a schematic view of the path of the flows of the adhesives in the operating condition of FIG. 22.

In the embodiment shown in FIG. 24, for example, two first layers 32*a* of a first adhesive and two second layers, designated by the reference numeral 32*b*, of a second adhesive, arranged alternately with respect to each other, have been obtained.

By opening both the third valve 15 and the fourth valve 22, which control the input respectively into the first extrusion chamber 41 and into the second extrusion chamber 42 arranged below the latter, it is possible to make both adhesives exit simultaneously from said first and second extrusion chambers, so as to achieve the spreading of a double layer.

Figure 23:
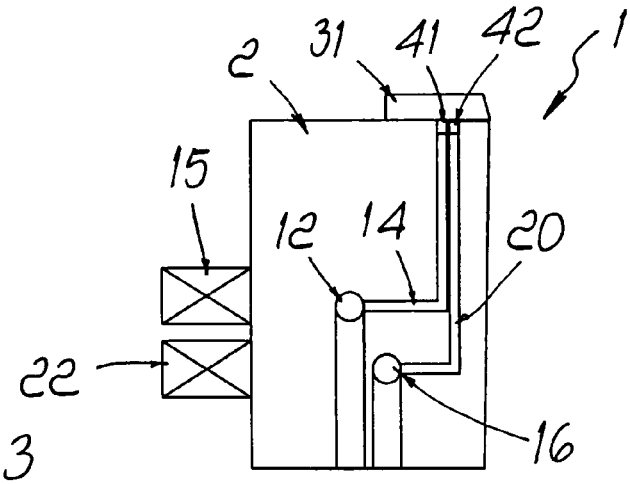
FIG. 23 is a transverse sectional view of a simplified configuration of the head according to the invention, which corresponds to the particular operating condition given in the description that refers to FIG. 22.
Figure 26:
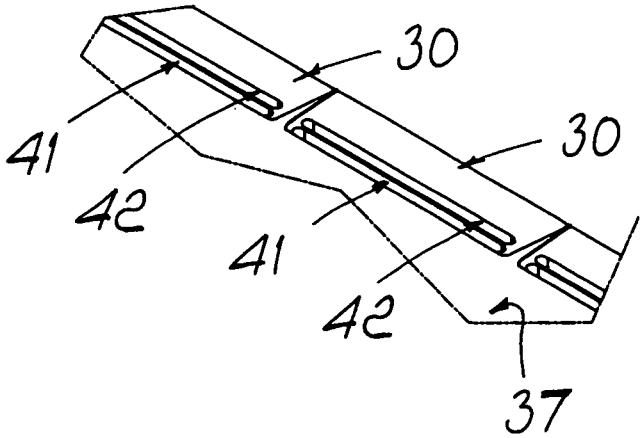
FIG. 26 is a view of a detail of the upper surface of the body of the simplified configuration shown in FIG. 23.
Figure 27:
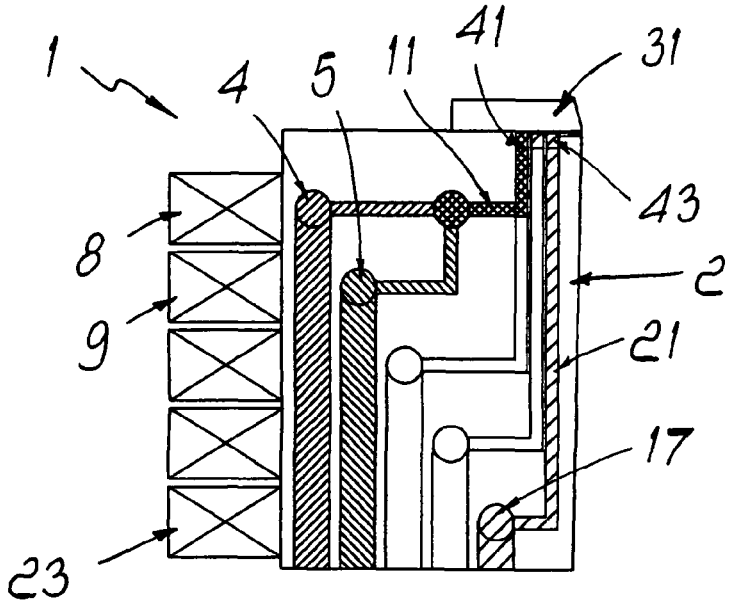
FIG. 27 is a transverse sectional view of a particular operating condition of the head according to the invention.

With reference to FIGS. 23 and 26, this distribution of the layers of adhesive in output can also be achieved with a simplified configuration of the spreading head 1, in which the body 2 has only the third duct 12 and the fourth duct 16, from which a corresponding number of second and third feed channels 14 and 20 exit respectively through one or more third valves 15 and fourth valves 22 and are connected respectively to one or more first extrusion chambers 41 and to one or more second extrusion chambers 42.

With reference to FIGS. 27 to 30, it is possible to feed the first duct 4 and the second duct 5 with two separate adhesives or with an adhesive and an appropriate catalyst and then the fifth duct 17 with an additional adhesive.

By opening the first and second valves 8 and 9, the adhesive or adhesives and the catalyst contained respectively in the first and second ducts enter the mixing channel 10, from which they exit, after being mixed, by means of the first extrusion channels 11, entering the first extrusion chambers 41.

By opening the fifth valves 23, the adhesive contained in the fifth duct 17 enters the fourth feed channels 21 and then exits from the third extrusion chambers 43.

Figure 30:
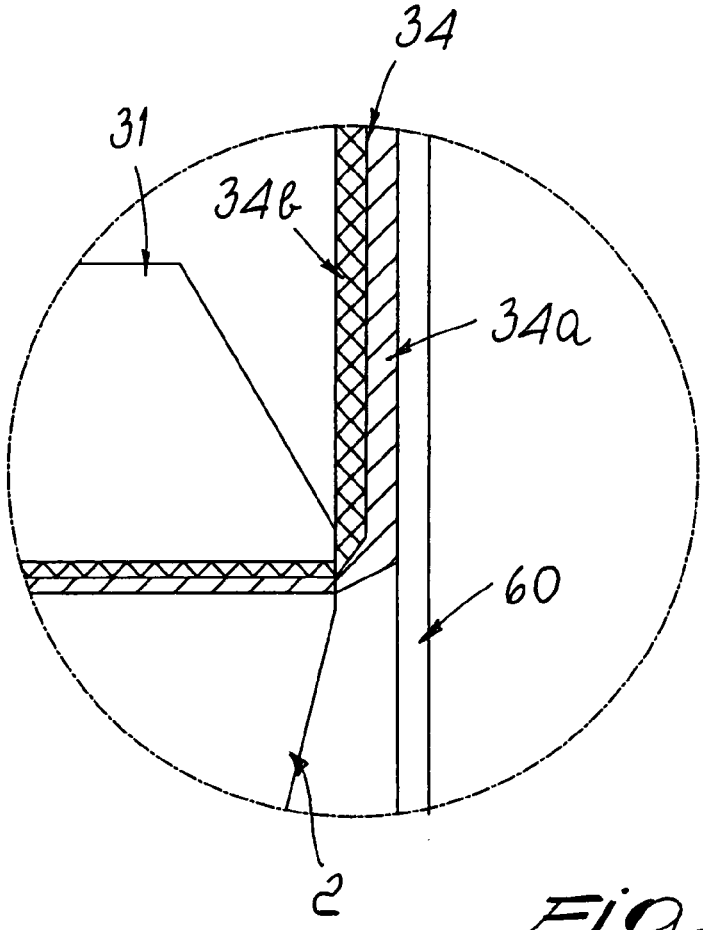
FIG. 30 is a schematic view of the provision of a double layer by using the operating condition of FIG. 29.
Figure 31:
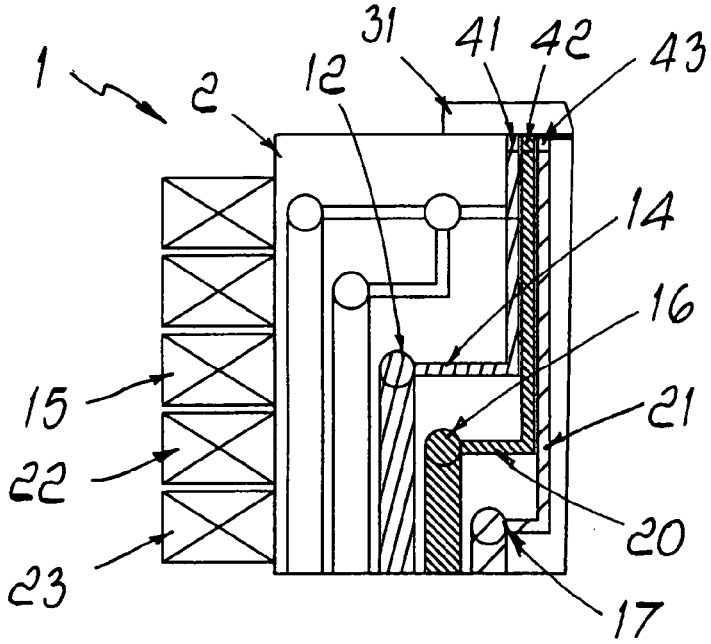
FIG. 31 is a transverse sectional view of another particular operating condition of the head according to the invention.

As shown in FIG. 30, the adhesive that exits from the first extrusion chambers 41 and the adhesive that exits from the underlying second extrusion chambers 43 are extruded simultaneously; such adhesives remain one on top of the other due to their different relative densities, thus forming a double layer, designated in FIG. 30 by the reference numeral 34, which is composed of a lower layer 34*a* of the first adhesive (which arrives from the fourth feed channels 21) and an upper layer 34*b* of the second adhesive (which arrives from the first feed channels 11).

By closing the first and second valves which enter a given mixing channel 10, or one of the fifth valves 23, it is also possible to achieve the extrusion of a single layer of adhesive or mixture of adhesives, respectively from one of the third extrusion chambers 43 or of the first extrusion chambers 41; it is thus possible to obtain in output a selected distribution of adhesives, not shown in the accompanying figures, which is constituted by a series of laterally adjacent layers, one or more of which is constituted by a single layer of one adhesive or the other, and one or more of which is constituted by a double layer which is similar to the one designated by the reference numeral 34 in FIG. 30.

Figure 28:
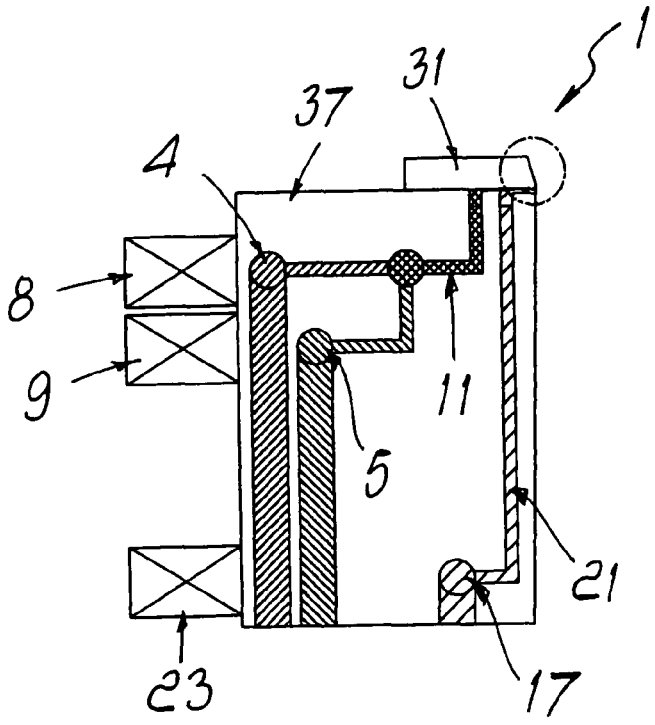
FIG. 28 is a transverse sectional view of a simplified configuration of the head according to the invention which corresponds to the particular operating condition given in the description which refers to FIG. 27.
Figure 29:
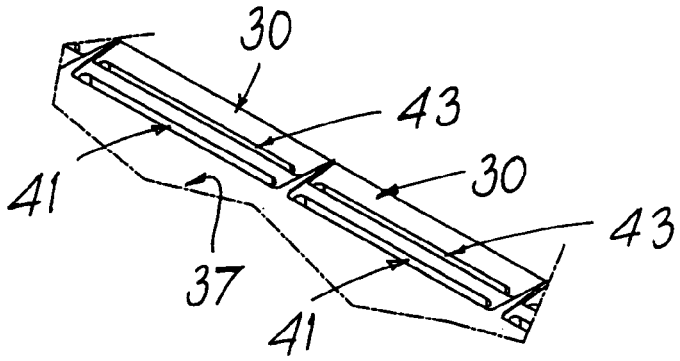
FIG. 29 is a view of a detail of the upper surface of the body of the simplified configuration shown in FIG. 28.

With reference to FIGS. 28, 29 and 30, this distribution of the adhesive layers in output can also be achieved with a simplified configuration of the spreading head 1, in which the body 2 has only the first duct 4 and the second duct 5, which mutually converge in a suitable mixing channel 10 with the interposition of the first and second valves; the body 2 further has the fifth duct 17 which is connected, by means of the fifth valves 23, to the fourth feed channels 21.

In this simplified configuration, only the first and third extrusion chambers are formed on the upper surface 37 of the body 2.

With reference to FIGS. 31 to 34, it is further possible to feed the third duct 12, the fourth duct 16 and the fifth duct 17 with separate adhesives and/or with the same adhesive at different grammages.

By opening the third valves 15, the fourth valves 22 and the fifth valves 23, these adhesives enter respectively the second feed channels 14, the third feed channels 20 and the fourth feed channels 21 and from there flow into the first, second and third extrusion chambers.

Figure 34:
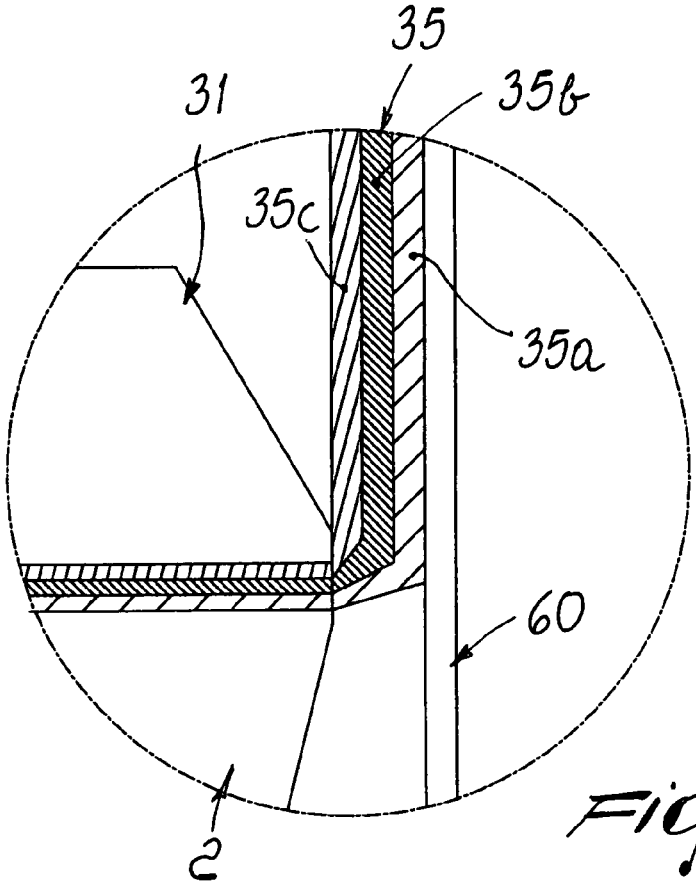
FIG. 34 is a schematic view of the provision of a triple layer by using the operating condition of FIG. 33.

The three adhesives thus exit simultaneously respectively from the first, second and third extrusion chambers so as to be mutually superimposed, forming a triple layer, designated in FIG. 34 by the reference numeral 35, which is constituted by a lower layer 35*a* of the first adhesive (which arrives from the fourth feed channels 21), by an intermediate layer 35*b* of the second adhesive (which arrives from the third feed channels 20), and by an upper layer 35*c* of the third adhesive, or optionally again of the first adhesive (which arrives from the second feed channels 14).

By closing selectively the third, fourth and fifth valves, it is further possible to achieve the extrusion of a single layer of adhesive or also of a double layer; a distribution of adhesives, not shown in the accompanying figures, can thus be obtained in output, which is constituted by a series of laterally adjacent layers, of which one or more is constituted by a single layer of a chosen adhesive and optionally one or more is constituted by a double layer and one or more is constituted by a triple layer.

Figure 32:
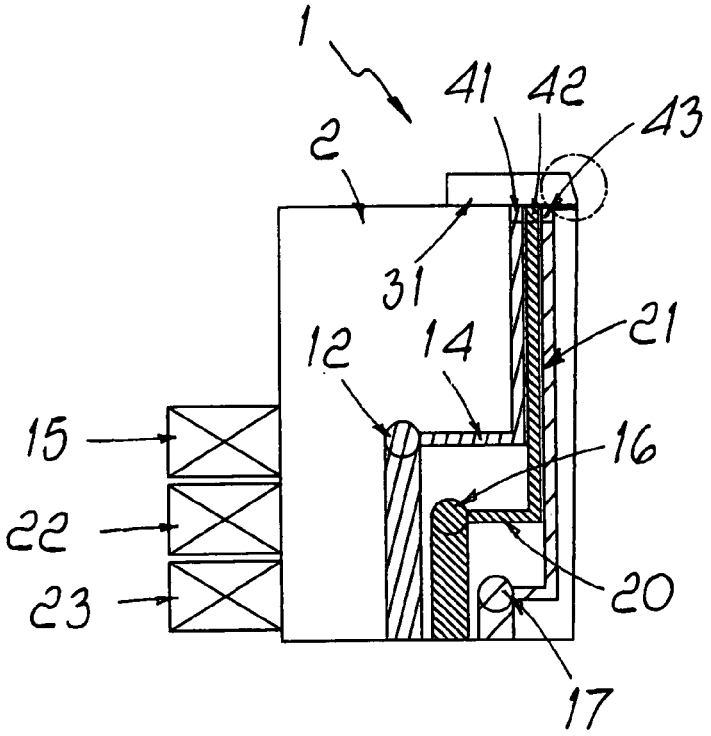
FIG. 32 is a transverse sectional view of a simplified configuration of the head according to the invention, which corresponds to the particular operating condition given in the description which refers to FIG. 31.
Figure 33:
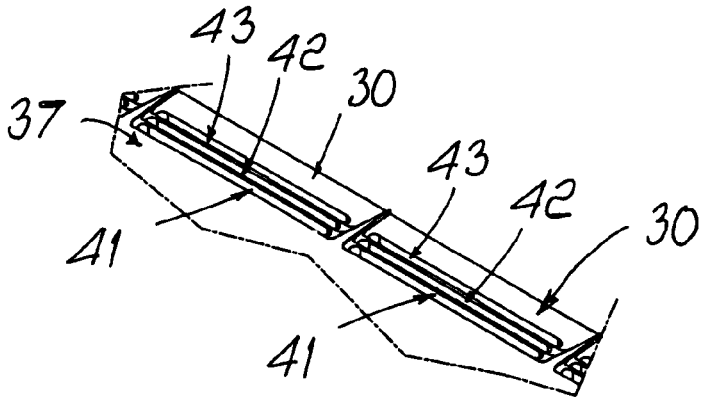
FIG. 33 is a view of a detail of the upper surface of the body of the simplified configuration shown in FIG. 32.

With reference to FIGS. 32, 33 and 34, this distribution of the layers of adhesives in output can also be achieved with a simplified configuration of the spreading head 1, in which the body 2 has only the third, fourth and fifth ducts and the respective third, fourth and fifth valves, through which said ducts are connected respectively to the second, third and fourth feed channels.

In this simplified configuration, on the upper surface 37 of the body 2 there are a plurality of sets of three extrusion chambers, each constituted by a first, second and third extrusion chamber, which are connected respectively to one or more second, third or fourth feed channels.

It has thus been found that the invention has achieved the intended aim and objects, a spreading head having been devised which allows to apply to selected areas of a substrate a chosen adhesive and/or different adhesives and/or a same adhesive with different grammages and/or a multiple layer of adhesives.

The spreading head according to the invention therefore allows to provide areas with differentiated grammage and also using differentiated adhesives, so as to be able to reduce (even by 70%, as has been found) the amount of (more expensive) structural adhesive that is required.

Further, the spreading head according to the invention allows to achieve the spreading on a substrate of a selected number of layers of adhesive arranged side-by-side and having a chosen width.

Moreover, the spreading head according to the invention allows to mix various adhesives or an adhesive and a suitable catalyst directly within the body.

By means of the spreading head according to the invention it is further possible to achieve, even in a single pass, the spreading of a multilayer film of adhesives, so as to be able to use products with a good grip on different substrates.

Thanks to the possibility to achieve the spreading of adhesives in multiple layers, the need is further avoided to use high-value adhesives even if their use is required only by one of the two surfaces to which they are to be applied.

Moreover, in cases in which the adhesive, in addition to having a structural function, also has the task of "filling" porous surfaces (for example in the lamination of recycled products or of products on chipwood panel substrates), the spreading head according to the invention allows to reduce the waste of "high-value" product, by making a low-cost resin perform the nonstructural function and making a thin layer of high-value resin perform the structural effect.

Further, the spreading head according to the invention allows to provide, even with a single pass, a membrane which has breathability characteristics in certain regions and a vapor barrier effect in others.

Moreover, the spreading head according to the invention is adapted for use for spreading thermoplastic adhesives and cold adhesives.

Moreover, the production costs of the spreading head according to the invention remain low, since it is made of components which are easy to manufacture and/or assemble.

The invention is of course susceptible of numerous modifications and variations, all of which are within the scope of the appended claims.

Of course, the materials used, as well as the dimensions that constitute the individual components of the invention, may be more pertinent according to specific requirements.

The various means for performing certain different functions need not certainly coexist only in the illustrated embodiments but can be present per se in many embodiments, including ones that are not illustrated.

Of course, the selection of the feed to the extrusion tool of the chosen type of adhesive and/or mixtures of adhesives and/or catalysts can occur not only by activating or not activating the mentioned preset valves but also by way of equivalent means, such as for example the interposition of appropriately provided plates which are selectively perforated between the body and the extrusion tool.

The characteristics indicated as advantageous, convenient or the like may also be omitted or be replaced with equivalents.

The disclosures in Italian Patent Application No. TV2006A000123 from which this application claims priority are incorporated herein by reference.

What is claimed is:

1. A spreading head for spreading at least a first adhesive and a second adhesive onto a substrate, comprising:

a body for conveying said first adhesive and said second adhesive, two or more ducts formed within said body for introducing in said ducts said first and second adhesives, said ducts being mutually separate ducts such that said first and second adhesives are introduced mutually separately in said ducts, each duct being connected to a plurality of feed channels formed within said body for conveying said first and second adhesives to a plurality of extrusion chambers formed on an upper surface of said body, said plurality of feed channels exiting from each respective duct and being distributed and spaced along a longitudinal extension of each respective duct, and said plurality of feed channels being connected in output to said extrusion chambers by a plurality of valves which allow to selectively feed through said plurality of feed channels into said extrusion chambers said first and second adhesives from said ducts, an abutment element for said first and second adhesives which exit from said extrusion chambers being connected to said mutually separate ducts and being arranged at said upper surface of said body, said plurality of extrusion chambers comprising at least two extrusion chambers that are arranged mutually laterally adjacent with respect to a width of said body, said two mutually laterally adjacent extrusion chambers being connected with respective ones of said feed channels such that said first and second adhesives introduced mutually separately in said mutually separate ducts also being capable of exiting mutually separately from said two mutually laterally adjacent extrusion chambers so as to obtain at least two layers of adhesive which are arranged laterally mutually adjacent on said substrate and which include said first adhesive which is arranged laterally mutually adjacent to said second adhesive on said substrate.

2. The spreading head of claim 1, wherein said one or more extrusion chambers are superimposed and/or laterally mutually adjacent.

3. The spreading head of claim 1, wherein at least two of said plurality of feed channels, connected respectively to a different one of said ducts, converge in at least one of said plurality of extrusion chambers.

4. The spreading head of claim 1, wherein one or more of said plurality of extrusion chambers have, along an axis which lies longitudinally to said body, reduced lengths that are mutually parallel and are arranged at right angles to said longitudinal axis.

5. The spreading head of claim 1, wherein a first duct and a second duct are formed within said body, are approximately mutually parallel and affect said body longitudinally and have respectively one or more first and second accesses for said adhesives, said first and second ducts being mutually connected inside said body.

6. The spreading head of claim 5, wherein said first and second ducts are connected respectively to one or more first output ducts and to one or more second output ducts, which converge in pairs, with the interposition of first and second valves, in mixing channels.

7. The spreading head of claim 6, wherein said one or more first and second output ducts are provided along axes which are substantially perpendicular to said first and second ducts, said one or more first and second output ducts being distributed respectively along said first and second ducts.

8. The spreading head of claim 7, wherein at least one first feed channel exits from each of said mixing channels in order to convey said adhesives to one or more first extrusion chambers formed on said upper surface of said body.

9. The spreading head of claim 8, wherein said one or more first extrusion chambers are laterally mutually adjacent and aligned along a same axis which lies longitudinally to said body.

10. The spreading head of claim 9, wherein said body has a third duct, which is approximately parallel to said first and second ducts, affects said body longitudinally and has one or more third accesses for said adhesives, one or more second feed channels exiting from said third duct for conveying said adhesives again to said first extrusion chambers, one or more of said first feed channels and one or more of said second feed channels leading to each of said first extrusion chambers.

11. The spreading head of claim 10, wherein said second feed channels are connected to said third duct by means of third valves.

12. The spreading head of claim 11, wherein said second feed channels are provided along axes which are substantially perpendicular to the longitudinal axis of said third duct and are distributed, preferably equidistantly, along said third duct.

13. The spreading head of claim 12, wherein said body has a fourth duct which is approximately parallel to said first, second and third ducts, affects said body longitudinally and is provided with fourth accesses for said adhesives, one or more third feed channels exiting from said fourth duct to convey said adhesives to one or more second extrusion chambers formed on said upper surface of said body.

14. The spreading head of claim 13, wherein said third feed channels are connected to said fourth duct by means of fourth valves.

15. The spreading head of claim 14, wherein said third feed channels are provided along axes which are substantially perpendicular to the longitudinal axes of said fourth duct and are distributed, preferably equidistantly, along said fourth duct.

16. The spreading head of claim 15, wherein said body has a fifth duct which is approximately parallel to said first, second, third and fourth ducts, affects said body longitudinally and has fifth accesses for said adhesives, one or more fourth feed channels exiting from said fifth duct for conveying said adhesives to one or more third extrusion chambers formed on said upper surface of said body.

17. The spreading head of claim 16, wherein said fourth feed channels are connected to said fifth duct by means of fifth valves.

18. The spreading head of claim 17, wherein said fourth feed channels are provided along axes which are substantially perpendicular to the longitudinal axes of said fifth duct and are distributed, preferably equidistantly, along said fifth duct.

19. The spreading head of claim 18, wherein said second extrusion chambers and said third extrusion chambers are aligned respectively along two axes which are arranged longitudinally with respect to said body and are substantially parallel and spaced with respect to each other and with respect to the axis along which said first extrusion chambers are aligned.

20. The spreading head of claim 19, wherein a plurality of sets of three of said extrusion chambers are formed on the upper surface of said body, are mutually laterally adjacent and are each constituted by one of said first extrusion chambers, by one of said second extrusion chambers, and by one of said third extrusion chambers, which are parallel to each other and to the longitudinal axis of said body.

21. The spreading head of claim 20, wherein the shape and size of said first, second and third extrusion chambers that compose each of said sets are the same.

22. The spreading head of claim 21, wherein the longitudinal extension of said first, second and third extrusion chambers of each of said sets is the same, while the longitudinal extension of two of said mutually laterally adjacent sets can be the same or different.

23. The spreading head of claim 22, wherein in each of said sets of three extrusion chambers the outlet of said third extrusion chamber, which lies closest to a lamination plane, is arranged, with respect to said lamination plane, at a lower height than said adjacent second extrusion chamber, which in turn is at a lower height than said adjacent first extrusion chamber, which lies furthest from said lamination plane.

24. The spreading head of claim 23, wherein said third feed channels and/or said fourth feed channels are connected to one or more additional fourth extrusion chambers, which have different shapes and arrangements with respect to said first, second and third extrusion chambers.

25. The spreading head of claim 24, wherein said fourth extrusion chambers are arranged along an axis which is perpendicular to the axis of said first, second and third extrusion chambers and are interposed between each pair of said sets of three of said extrusion chambers.

26. The spreading head of claim 25, wherein said fourth extrusion chambers start from the perimetric edge of the upper surface of said body which is directed toward said substrate during use.

27. The spreading head of claim 26, wherein a slit is formed in the upper surface of said body, so as to affect the outlet at least of said third extrusion chambers which lie closest to said lamination plane, said slit arranging on a lower plane the outlet of said third extrusion chambers with respect to the plane of arrangement of said second and first extrusion chambers.

28. The spreading head of claim 27, wherein one or more of said first and/or second and/or third and/or fourth extrusion chambers have reduced lengths along an axis which lies longitudinally to said body.

29. The spreading head of claim 28, wherein said extrusion chambers with reduced length are arranged at right angles to said first, second and third extrusion chambers, are mutually parallel and are interposed between two of said sets of three of said extrusion chambers.

30. The spreading head of claim 29, wherein the configuration of said extrusion chambers with reduced length with respect to said upper surface of said body is comb-like, with teeth which have two different lengths and are arranged alternately.

31. The spreading head of claim 30, wherein said abutment element is approximately shaped like a parallelepiped with a transverse cross-section shaped like a right-angled trapezoid.

32. The spreading head of claim 31, wherein said body has said first and third ducts, from which said first and second feed channels exit respectively through one or more of said first and third valves, only said first extrusion chambers being formed on said upper surface of said body, each of said first extrusion chambers being connected in input to one of said first feed channels and to one of said second feed channels, said first extrusion chambers being mutually laterally adjacent.

33. The spreading head of claim 32, wherein said body has said third and fourth ducts, from which said second and third feed channels exit respectively through one or more of said third and fourth valves, said feed channels being connected respectively to one or more of said extrusion chambers with reduced length arranged in a comb-like and mutually alternating configuration.

34. The spreading head of claim 32, wherein said body has said third and fourth ducts, from which said second and third feed channels exit respectively through one or more of said third and fourth valves, said feed channels being connected respectively to one or more of said first extrusion chambers and to one or more of said fourth extrusion chambers.

35. The spreading head of claim 32, wherein said body has said third and fourth ducts, from which said second and third feed channels exit respectively through one or more of said third and fourth valves, said feed channels being connected respectively to one or more of said first extrusion chambers and to one or more of said second extrusion chambers.

36. The spreading head of claim 32, wherein said body has said first and second ducts, which mutually converge in a said mixing channel with the interposition of said first and second valves, said body further having said fifth duct which is connected, by means of said fifth valves, to said fourth feed channels, only said first and third extrusion chambers being formed on said upper surface of said body.

37. The spreading head of claim 32, wherein said body has said third, fourth and fifth ducts and said third, fourth and fifth valves, through which said ducts are connected respectively to said second, third and fourth feed channels, a plurality of said sets of three of said extrusion chambers being formed on the upper surface of said body, each set being constituted by one of said first, second and third extrusion chambers, which are connected respectively to one or more of said second, third or fourth feed channels.

* * * * *